US011099509B2

(12) United States Patent
Fujimoto et al.

(10) Patent No.: US 11,099,509 B2
(45) Date of Patent: Aug. 24, 2021

(54) FIXING DEVICE AND IMAGE FORMING APPARATUS

(71) Applicant: Ricoh Company, Ltd., Tokyo (JP)

(72) Inventors: Ippei Fujimoto, Kanagawa (JP); Yoshiki Yamaguchi, Kanagawa (JP); Takashi Seto, Kanagawa (JP); Hiroshi Yoshinaga, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/110,485

(22) Filed: Dec. 3, 2020

(65) Prior Publication Data

US 2021/0191301 A1 Jun. 24, 2021

(30) Foreign Application Priority Data

Dec. 20, 2019 (JP) ..... JP2019-230620

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/2017; G03G 15/2053; G03G 15/2039; G03G 15/2042
See application file for complete search history.

(56) References Cited

U.S. PATENT DOCUMENTS

2015/0261155 A1 9/2015 Yoshiura et al.
2017/0176906 A1 6/2017 Sawada et al.
2017/0185009 A1 6/2017 Yoshinaga et al.
2017/0185015 A1 6/2017 Yoshinaga et al.
2017/0185021 A1* 6/2017 Seki ..... G03G 15/2053
2017/0261900 A1 9/2017 Sawada et al.
2017/0364000 A1* 12/2017 Seki ..... G03G 15/2053
2018/0173138 A1* 6/2018 Seki ..... G03G 15/2017
2018/0284669 A1* 10/2018 Fujimoto ..... G03G 15/2039
2018/0335733 A1 11/2018 Matsuda et al.

FOREIGN PATENT DOCUMENTS

JP 2014-174370 9/2014
JP 2016-033636 3/2016
JP 2018-169467 11/2018
JP 2018169467 * 11/2018

* cited by examiner

*Primary Examiner* — Sandra Brase
(74) *Attorney, Agent, or Firm* — Xsensus LLP

(57) ABSTRACT

A fixing device includes an endless belt that rotates and is heated by a heat source. A thermal conduction aid includes a contact portion, an upstream bent portion, and a downstream bent portion. The contact portion contacts the endless belt. The upstream bent portion and the downstream bent portion are disposed upstream and downstream from the contact portion in a rotation direction of the endless belt, respectively, and are extended in a longitudinal direction of the thermal conduction aid. A recess is disposed in at least one of the upstream bent portion and the downstream bent portion. The recess spans a center of the thermal conduction aid in the longitudinal direction thereof and is recessed from an edge of the at least one of the upstream bent portion and the downstream bent portion in a short direction thereof.

9 Claims, 7 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-230620, filed on Dec. 20, 2019, in the Japan Patent Office, the entire disclosure of which is hereby incorporated by reference herein.

BACKGROUND

Technical Field

Exemplary aspects of the present disclosure relate to a fixing device and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

The image forming apparatuses form a toner image through image forming processes of electrophotographic recording, electrostatic recording, magnetic recording, or the like and transfer the toner image onto a recording medium by an indirect transfer method (e.g., an image transfer method) or a direct transfer method, thus forming an unfixed toner image on the recording medium. Such image forming apparatuses include a fixing device that fixes the unfixed toner image on the recording medium. The fixing device includes a fixing belt, that is, an endless belt serving as a fixing rotator, and a pressure roller. As the recording medium bearing the unfixed toner image is conveyed through a nip formed between the fixing belt and the pressure roller, the fixing belt and the pressure roller fix the unfixed toner image on the recording medium under heat and pressure.

The pressure roller is pressed against a nip former via the fixing belt at the nip. As the fixing belt rotates, an inner circumferential surface of the fixing belt slides over the nip former. The nip former mounts a thermal conduction aid that diffuses and conducts heat in the fixing belt.

SUMMARY

This specification describes below an improved fixing device. In one embodiment, the fixing device includes an endless belt that rotates in a rotation direction and a heat source that heats the endless belt. A nip former is stationarily disposed within a loop formed by the endless belt. A pressure rotator is disposed opposite the nip former via the endless belt to form a nip between the endless belt and the pressure rotator. A recording medium bearing an image is conveyed through the nip. A thermal conduction aid facilitates conduction of heat in the endless belt. The thermal conduction aid includes a contact portion that contacts the endless belt. An upstream bent portion is disposed upstream from the contact portion in the rotation direction of the endless belt and extended in a longitudinal direction of the thermal conduction aid. A downstream bent portion is disposed downstream from the contact portion in the rotation direction of the endless belt and extended in the longitudinal direction of the thermal conduction aid. A recess is disposed in at least one of the upstream bent portion and the downstream bent portion. The recess spans a center of the thermal conduction aid in the longitudinal direction of the thermal conduction aid and is recessed from an edge of the at least one of the upstream bent portion and the downstream bent portion in a short direction of the at least one of the upstream bent portion and the downstream bent portion.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
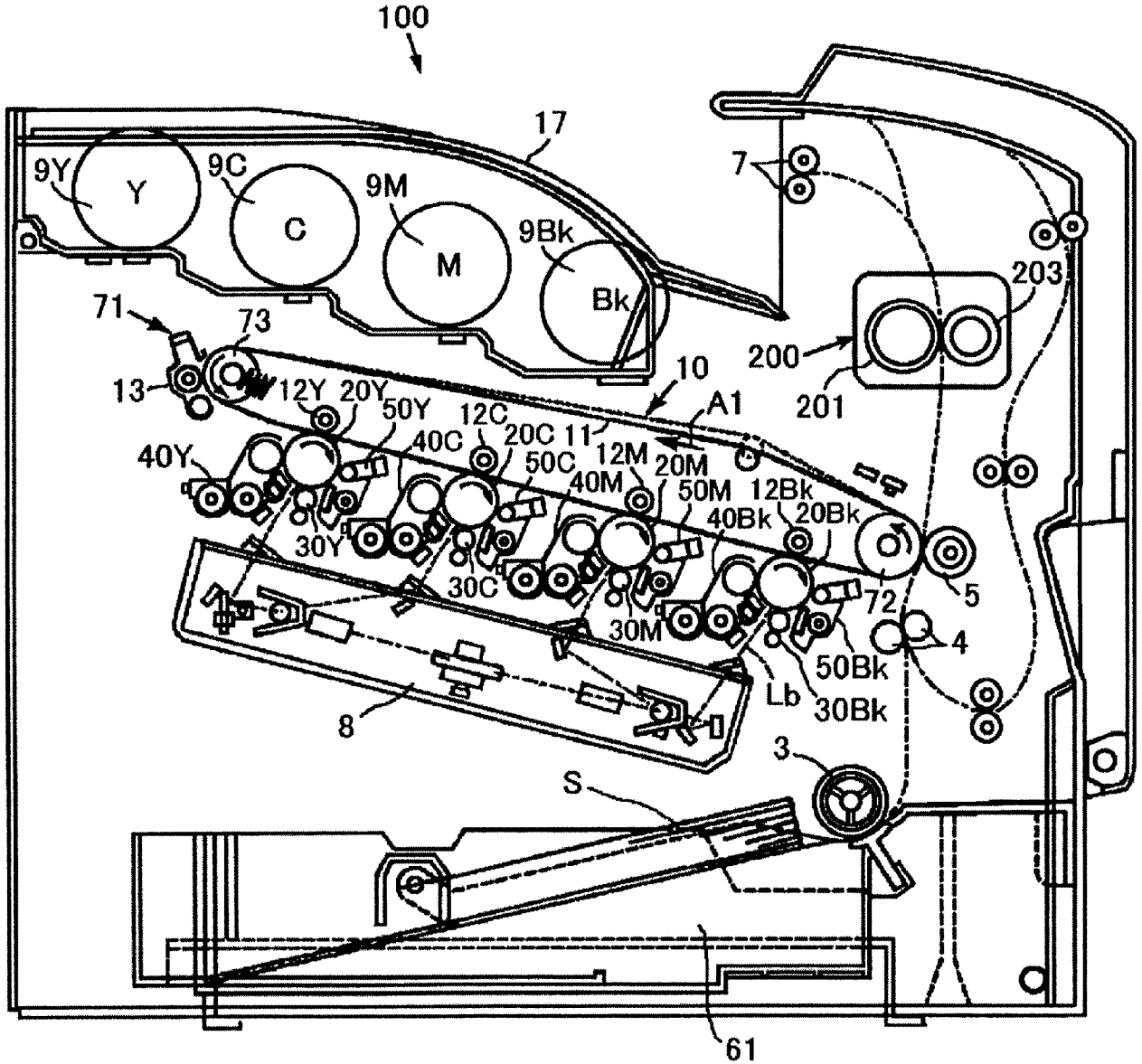
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a fixing device and an image forming apparatus according to embodiments of the present disclosure.

The technology of the present disclosure is not limited to the embodiments described below and may be modified within scopes suggested by those skilled in art, such as other embodiments, addition, modification, and deletion. The technology of the present disclosure encompasses various embodiments that achieve operations and advantages of the technology of the present disclosure.

A description is provided of a construction of an image forming apparatus 100.

FIG. 1 is a schematic cross-sectional view of the image forming apparatus 100 according to an embodiment of the present disclosure.

The image forming apparatus 100 illustrated in FIG. 1 is a color printer employing a tandem system in which a plurality of image forming devices that forms images in a plurality of colors, respectively, is aligned in a stretch direction of a transfer belt 11. Alternatively, the image forming apparatus 100 may employ systems other than the tandem system. According to this embodiment, the image forming apparatus 100 is a printer. Alternatively, the image forming apparatus 100 may be a copier, a facsimile machine, or the like.

The image forming apparatus 100 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt that rotates in a direction A1 while the transfer belt 11 is disposed opposite the photoconductive drums 20Y, 20C, 20M, and 20Bk. In the primary transfer process, yellow, cyan, magenta, and black toner images are transferred onto the transfer belt 11 such that the yellow, cyan, magenta, and black toner images are superimposed on the transfer belt 11. Thereafter, the visible images formed on the transfer belt 11 are transferred collectively onto a recording medium S (e.g., a recording sheet) in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk that forms the black toner image as an example, a charger 30Bk, a developing device 40Bk, a primary transfer roller 12Bk, and a cleaner 50Bk which form the black toner image are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 8 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. The primary transfer rollers 12Y, 12C, 12M, and 12Bk disposed opposite the photoconductive drums 20Y, 20C, 20M, and 20Bk via the transfer belt 11 apply a voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from the upstream photoconductive drum 20Y to the downstream photoconductive drum 20Bk in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 5, a belt cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 is disposed opposite the transfer belt 11 and rotates in accordance with rotation of the transfer belt 11. The belt cleaner 13 is disposed opposite the transfer belt 11 and cleans the transfer belt 11. The optical writing device 8 is disposed opposite and below the four imaging stations.

The optical writing device 8 includes a semiconductor laser serving as a light source, a coupling lens, an f-θ lens, a toroidal lens, a reflection mirror, and a polygon mirror serving as a deflector. The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the light beam Lb directed to the imaging station that forms the black toner image, the light beams Lb are also directed to the imaging stations that form the yellow, cyan, and magenta toner images, respectively.

The image forming apparatus 100 further includes a sheet feeder 61, a registration roller pair 4, and a sensor. The sheet feeder 61 is a sheet feeding tray (e.g., a paper tray) that loads recording media S to be conveyed to a secondary transfer nip formed between the secondary transfer roller 5 and the transfer belt 11. The registration roller pair 4 feeds the recording medium S conveyed from the sheet feeder 61 to the secondary transfer nip formed between the secondary transfer roller 5 and the transfer belt 11 at a predetermined time when the yellow, cyan, magenta, and black toner images formed on the transfer belt 11 by the imaging stations reach the secondary transfer nip. The sensor detects that a leading edge of the recording medium S reaches the registration roller pair 4.

The image forming apparatus 100 further includes a fixing device 200, a sheet ejection roller pair 7, a sheet ejection tray 17, and toner bottles 9Y, 9C, 9M, and 9Bk. The fixing device 200 is a fuser unit that fixes a color toner image on the recording medium S in a belt fixing method. The color toner image is formed by transferring the yellow, cyan, magenta, and black toner images formed on the transfer belt 11 onto the recording medium S. The sheet ejection roller pair 7 ejects the recording medium S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording media S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. Hence, a biasing member such as a spring biases the driven roller 73 against the transfer belt 11. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording medium S. As the sheet feeding roller 3 is driven and rotated counterclockwise in FIG. 1, the sheet feeding roller 3 feeds the uppermost recording medium S to the registration roller pair 4.

The belt cleaner 13 installed in the transfer device 71, although the belt cleaner 13 is schematically illustrated in FIG. 1, includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11.

The belt cleaner 13 further includes a discharging device that conveys the residual toner removed from the transfer belt 11 for disposal.

A description is provided of a construction of the fixing device 200.

Figure 2:
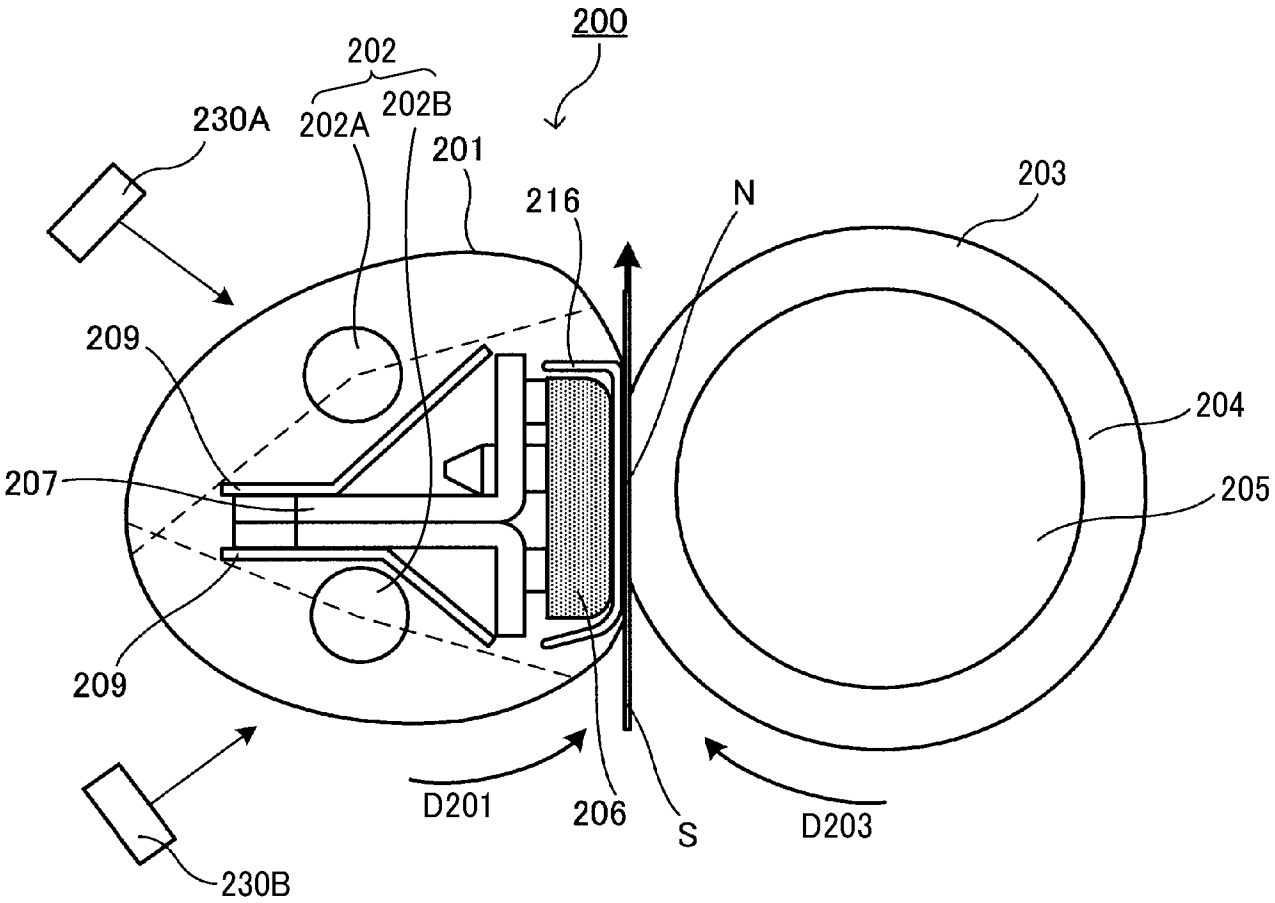
FIG. 2 is a schematic cross-sectional view of a fixing device incorporated in the image forming apparatus depicted in FIG. 1.

FIG. 2 is a schematic cross-sectional view of the fixing device 200 according to an embodiment of the present disclosure.

As illustrated in FIG. 2, the fixing device 200 includes a fixing belt 201, a heat source pair 202, a nip former 206, a thermal conduction aid 216, and a pressure roller 203. The fixing belt 201 is an endless belt that is rotatable in a rotation direction D201 and serves as a fixing rotator or a fixing member. The heat source pair 202 heats the fixing belt 201. The nip former 206 (e.g., a nip formation pad) is stationarily disposed within a loop formed by the fixing belt 201 such that the nip former 206 is disposed opposite an inner circumferential surface of the fixing belt 201. The thermal conduction aid 216 facilitates conduction of heat in the fixing belt 201. The pressure roller 203 is rotatable in a rotation direction D203 and serves as a pressure rotator or a pressure member that is disposed opposite an outer circumferential surface of the fixing belt 201. The pressure roller 203 is disposed opposite the nip former 206 via the fixing belt 201 to form a fixing nip N between the fixing belt 201 and the pressure roller 203. As a recording medium S bearing an unfixed toner image is conveyed through the fixing nip N, the fixing belt 201 and the pressure roller 203 fix the unfixed toner image on the recording medium S.

The heat source pair 202 includes a plurality of heat sources 202A and 202B (e.g., halogen heaters). The heat sources 202A and 202B are disposed opposite the inner circumferential surface of the fixing belt 201 and heat the fixing belt 201 directly with radiant heat.

Temperature sensors 230A and 230B are disposed opposite the outer circumferential surface of the fixing belt 201 and detect the temperature of the fixing belt 201. The temperature sensors 230A and 230B detect the temperature of the fixing belt 201 without contacting the fixing belt 201. A controller controls lighting rates of the heat sources 202A and 202B based on temperatures of the fixing belt 201 that are detected by the temperature sensors 230A and 230B, respectively, thus adjusting the temperature of the fixing belt 201 to a desired temperature. For example, the controller controls heat generation (e.g., energization) of the heat sources 202A and 202B so that temperatures detected by the temperature sensors 230A and 230B reach predetermined target temperatures, respectively.

The heat sources 202A and 202B are hereinafter referred to as the heat source pair 202 when the heat source 202A is not distinguished from the heat source 202B.

As illustrated in FIG. 2, inside the loop formed by the fixing belt 201 are the nip former 206, the thermal conduction aid 216, and a stay 207. The nip former 206 is disposed opposite the pressure roller 203 via the fixing belt 201. The thermal conduction aid 216 covers a belt side face of the nip former 206, that is disposed opposite the inner circumferential surface of the fixing belt 201. The stay 207 supports the nip former 206 against pressure from the pressure roller 203.

The nip former 206 presses against the pressure roller 203 via the fixing belt 201 to form the fixing nip N between the fixing belt 201 and the pressure roller 203. The inner circumferential surface of the fixing belt 201 slides over the nip former 206 indirectly via the thermal conduction aid 216. As a recording medium S bearing a toner image passes through the fixing nip N, the fixing belt 201 and the pressure roller 203 melt toner of the toner image borne on the recording medium S under heat and fix the toner image on the recording medium S under pressure.

A contact face of the thermal conduction aid 216, that contacts the fixing belt 201, is treated with a slide coating that decreases a coefficient of friction and facilitates sliding of the fixing belt 201. As the slide coating, for example, a fluorine coating, a glass coating with diamond-like carbon (DLC) or the like having an increased abrasion resistance, or the like is used.

The contact face of the thermal conduction aid 216, that contacts the fixing belt 201, is applied with a lubricant. Fluorine grease or silicone oil that has an increased heat resistant temperature is used as the lubricant. The fluorine grease is a lubricant prepared by dispersing a thickener in fluorine oil as base oil to produce a gel. Since a viscosity of the fluorine grease is greater than a viscosity of oil, the fluorine grease is effectively used to prevent the lubricant from leaking from a slide portion of the thermal conduction aid 216, over which the fixing belt 201 slides.

The thermal conduction aid 216 prevents heat from being stored locally. The thermal conduction aid 216 conducts heat in a longitudinal direction thereof, facilitating conduction of heat in the fixing belt 201 in a longitudinal direction thereof and therefore decreasing unevenness in the temperature of the fixing belt 201 in the longitudinal direction thereof.

Hence, the thermal conduction aid 216 is preferably made of a material that conducts heat in a shortened time period. For example, the thermal conduction aid 216 is made of a material having an increased thermal conductivity, such as copper, aluminum, and silver. Copper is most preferable by comprehensively considering costs, availability, thermal conductivity, and processing.

According to this embodiment, the contact face of the thermal conduction aid 216, that contacts the fixing belt 201 directly, serves as a nip forming face that defines the fixing nip N.

A construction of the thermal conduction aid 216 according to the embodiments of the present disclosure is described below in detail.

A detailed description is now given of a construction of the fixing belt 201.

The fixing belt 201 is an endless belt or film made of metal such as nickel and stainless used steel (SUS) or resin such as polyimide. The fixing belt 201 includes a base and a release layer. The release layer serves as a surface layer made of perfluoroalkoxy alkane (PFA), polytetrafluoroethylene (PTFE), or the like, facilitating separation of the recording medium S from the fixing belt 201 and preventing toner from adhering to the fixing belt 201. Optionally, an elastic layer made of silicone rubber or the like may be interposed between the base and the release layer. If the fixing belt 201 does not incorporate the elastic layer, the fixing belt 201 attains a decreased thermal capacity that improves a fixing property of being heated quickly. However, when the pressure roller 203 presses and deforms an unfixed toner image to fix the toner image on the recording medium S, slight surface asperities of the fixing belt 201 may be transferred onto the toner image, causing a disadvantage that an orange peel mark remains on a solid part of the toner image as uneven gloss of the toner image or an orange peel image. To address this circumstance, the elastic layer has a thickness of 100 μm or more. As the elastic layer deforms, the elastic layer absorbs the slight surface asperities, preventing the orange peel mark on the toner image.

A sliding face of the fixing belt 201, that slides over the thermal conduction aid 216, may be treated with the slide coating described above. In this case, considering heat resistance and abrasion resistance, a material such as polyimide and polyamide imide may be selected.

A detailed description is now given of a construction of the stay 207.

The stay 207 includes a base and an arm that projects from the base. The arm is disposed opposite the fixing nip N via the base. The heat source 202A is disposed opposite the heat source 202B via the arm. The heat source pair 202 disposed opposite the inner circumferential surface of the fixing belt 201 heats the fixing belt 201 directly with radiant heat in a circumferential span of the fixing belt 201 other than the fixing nip N.

The nip former 206 and the stay 207 serving as a support that supports the nip former 206 to define the fixing nip N are disposed inside the loop formed by the fixing belt 201. The stay 207 prevents the nip former 206 from being bent by pressure from the pressure roller 203, attaining a uniform length of the fixing nip N in a recording medium conveyance direction of the recording medium S throughout an entire span of the fixing belt 201 in an axial direction thereof. Both lateral ends of the stay 207 in the axial direction of the fixing belt 201 are supported by and secured to flanges serving as holders, respectively, thus being positioned inside the loop formed by the fixing belt 201.

The fixing device 200 further includes a reflector 209 interposed between the heat source 202A and the stay 207 and another reflector 209 interposed between the heat source 202B and the stay 207. The reflectors 209 reflect radiant heat and the like from the heat sources 202A and 202B, suppressing heating of the stay 207 with the radiant heat and the like and resultant waste of energy.

The reflectors 209 prevent the heat sources 202A and 202B from heating glass tubes thereof each other, causing the heat sources 202A and 202B to heat the fixing belt 201 effectively. The reflectors 209 are made of a material having a decreased thermal emissivity so that the reflectors 209 do not absorb heat from the heat sources 202A and 202B.

Instead of the reflectors 209, a surface of the stay 207 may be treated with thermal insulation or specular surface to attain similar advantages.

A detailed description is now given of a construction of the pressure roller 203.

The pressure roller 203 includes a cored bar 205, an elastic rubber layer 204, and a release layer. The elastic rubber layer 204 is disposed on the cored bar 205. The release layer serves as a surface layer that facilitates separation of the recording medium S from the pressure roller 203. The release layer is made of PFA, PTFE, or the like. A driving force is transmitted to the pressure roller 203 from a driver such as a motor disposed in the image forming apparatus 100 through a gear, thus rotating the pressure roller 203. A spring or the like presses the pressure roller 203 against the fixing belt 201. As the spring presses and deforms the elastic rubber layer 204, the pressure roller 203 forms the fixing nip N having a predetermined length in the recording medium conveyance direction. The pressure roller 203 may be a solid roller or a hollow roller. A heat source such as a halogen heater may be disposed inside the pressure roller 203 as the hollow roller. The elastic rubber layer 204 may be made of solid rubber. Alternatively, if no heater is disposed inside the pressure roller 203, sponge rubber may be used. The sponge rubber enhances thermal insulation of the pressure roller 203, preferably causing the pressure roller 203 to draw less heat from the fixing belt 201.

The fixing belt 201 rotates in accordance with rotation of the pressure roller 203. With the construction of the fixing device 200 illustrated in FIG. 2, as the driver drives and rotates the pressure roller 203, the driving force is transmitted from the pressure roller 203 to the fixing belt 201 at the fixing nip N, rotating the fixing belt 201 in accordance with rotation of the pressure roller 203. The fixing belt 201 rotates while the nip former 206 and the pressure roller 203 sandwich the fixing belt 201 at the fixing nip N. The fixing belt 201 rotates while the flanges guide the fixing belt 201 at both lateral ends of the fixing belt 201 in the axial direction thereof in the circumferential span of the fixing belt 201 other than the fixing nip N.

With the construction described above, the fixing device 200 attaining quick warmup is manufactured at reduced costs.

A description is provided of a construction of a first comparative fixing device and a second comparative fixing device.

A small recording medium having a width smaller than a heating span of a heat source in a longitudinal direction thereof may be conveyed through the first comparative fixing device. In this case, the small recording medium is not conveyed over each lateral end of a fixing belt serving as a fixing rotator in a longitudinal direction thereof, thus producing a non-conveyance span on the fixing belt. Since the small recording medium does not draw heat from the non-conveyance span on the fixing belt, the non-conveyance span on the fixing belt stores heat excessively, suffering from temperature increase. Accordingly, deterioration of the fixing belt may progress, shortening the life of the fixing belt.

To address this circumstance, the first comparative fixing device includes a thermal conduction aid made of a material having an increased thermal conductivity. The thermal conduction aid decreases unevenness in the temperature of the fixing belt in the longitudinal direction thereof, thus suppressing temperature increase of the non-conveyance span on the fixing belt.

On the other hand, the thermal conduction aid may diffuse heat, decreasing the temperature of each lateral end of the fixing belt in the longitudinal direction thereof.

To address this circumstance, the second comparative fixing device includes a temperature detector that detects the temperature of a lateral end of the fixing belt in the longitudinal direction thereof. A thermal capacity of a lateral end portion of the thermal conduction aid, that contacts the lateral end of the fixing belt, of which temperature is detected by the temperature detector, is greater than a thermal capacity of a portion of the thermal conduction aid other than the lateral end portion. Thus, the second comparative fixing device equalizes the temperature of the fixing belt in the longitudinal direction thereof immediately after the second comparative fixing device is warmed up.

As described above, the thermal conduction aid is made of the material having the increased thermal conductivity. Accordingly, unevenness in the temperature of the fixing belt in the longitudinal direction thereof decreases, thus suppressing temperature increase of the non-conveyance span on the fixing belt, that might occur when the small recording medium is conveyed over the fixing belt and improving productivity when small recording media are conveyed over the fixing belt continuously.

However, the thermal conduction aid having the increased thermal conductivity may draw heat from the fixing belt easily, lengthening a warm-up time of the fixing belt.

Additionally, the fixing belt slides over the thermal conduction aid at a fixing nip. Hence, when the thermal conduction aid is installed in the first comparative fixing device or the second comparative fixing device, the thermal conduction aid is requested not to interfere with the fixing belt and not to hinder stable rotation of the fixing belt.

A description is provided of a construction of a thermal conduction aid 216C according to a comparative example.

Figure 3:
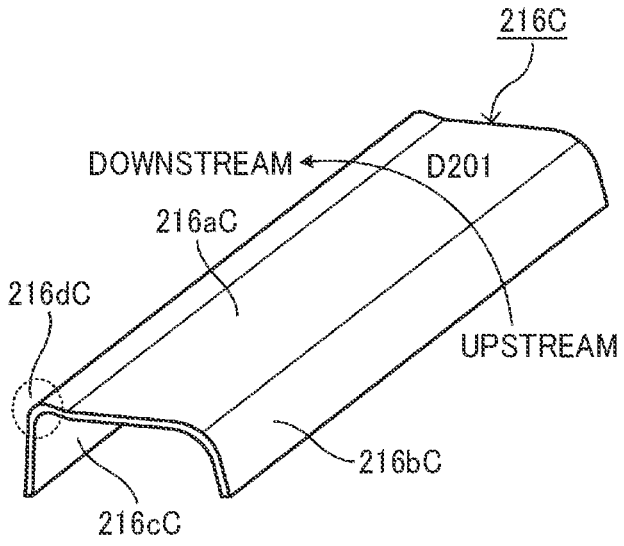
FIG. 3 Conventional Art
FIG. 3 is an external perspective view of a thermal conduction aid according to a comparative example.

FIG. 3 illustrates one example of the shape of the thermal conduction aid 216C.

The thermal conduction aid 216C includes a contact portion 216*a*C and bent portions 216*b*C and 216*c*C. The contact portion 216*a*C contacts the fixing belt 201. The bent portions 216*b*C and 216*c*C are disposed upstream and downstream from the contact portion 216*a*C, respectively, in the rotation direction D201 of the fixing belt 201 and are extended in a longitudinal direction of the thermal conduction aid 216C. Each end of the thermal conduction aid 216C in a short direction thereof is C-shaped or curved in a cross section perpendicular to the longitudinal direction of the thermal conduction aid 216C such that the thermal conduction aid 216C does not interfere with the fixing belt 201.

The bent portion 216*b*C is disposed upstream from the contact portion 216*a*C in the rotation direction D201 of the fixing belt 201 and disposed opposite an entry to the fixing nip N. The bent portion 216*b*C has a gentler curve compared to the bent portion 216*c*C disposed downstream from the contact portion 216*a*C in the rotation direction D201 of the fixing belt 201 and disposed opposite an exit of the fixing nip N. If the bent portion 216*b*C is steep, a corner of the bent portion 216*b*C may contact the inner circumferential surface of the fixing belt 201 linearly, exerting an increased load on the inner circumferential surface of the fixing belt 201 and causing deformation and breakage of the fixing belt 201.

On the other hand, the thermal conduction aid 216C includes a projection 216*d*C that is disposed downstream from the contact portion 216*a*C in the rotation direction D201 of the fixing belt 201 and disposed opposite the exit of the fixing nip N. When the thermal conduction aid 216C is installed in a fixing device, the projection 216*d*C projects toward the pressure roller 203. The projection 216*d*C directs a trajectory of the fixing belt 201 that rotates in the rotation direction D201 toward the pressure roller 203 at the exit of the fixing nip N, thus facilitating separation of a recording medium S conveyed through the exit of the fixing nip N from the fixing belt 201.

A length of the thermal conduction aid 216C in the longitudinal direction thereof is greater than a length of the pressure roller 203 in a longitudinal direction thereof, preventing a lateral edge of the thermal conduction aid 216C in the longitudinal direction thereof from contacting the pressure roller 203.

Since the thermal conduction aid 216C is disposed opposite the fixing nip N, the thermal conduction aid 216C is requested to have an increased mechanical strength. Hence, the thermal conduction aid 216C preferably has a thickness in a range of from 0.6 mm to 1.0 mm.

As described above, the thermal conduction aid 216C is C-shaped or curved in the cross section perpendicular to the longitudinal direction of the thermal conduction aid 216C. The length of the thermal conduction aid 216C in the longitudinal direction thereof is greater than the length of the pressure roller 203 in the longitudinal direction thereof. The thermal conduction aid 216C has a fixed thickness. Accordingly, the thermal conduction aid 216C may have an increased thermal capacity disadvantageously.

Figure 4:
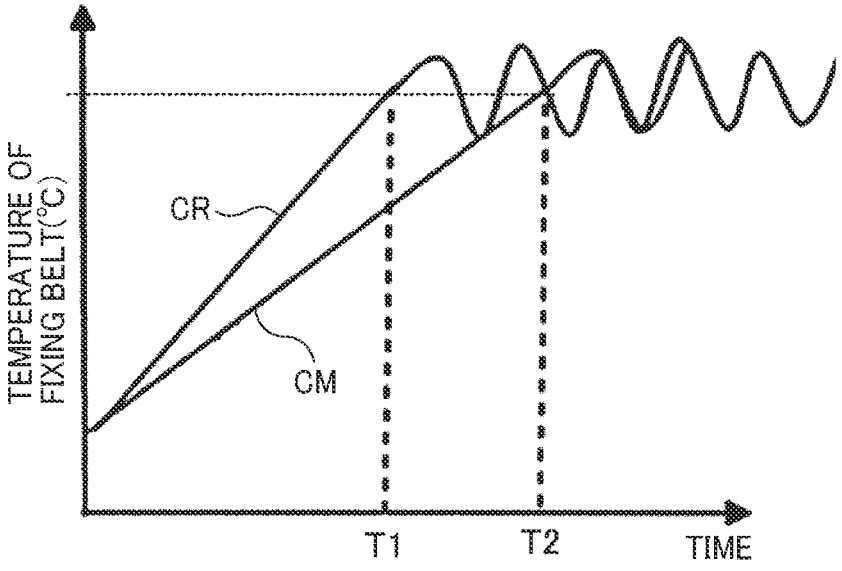
FIG. 4 is a graph that compares a warm-up time of a fixing belt between a thermal conduction aid, that is installable in the fixing device depicted in FIG. 2 and is made of metal, and another thermal conduction aid that is made of resin.

FIG. 4 is a graph that compares a warm-up time of the fixing belt 201 between the thermal conduction aid 216 made of metal and the thermal conduction aid 216 made of resin. In FIG. 4, a curve CM indicates temperature change of the fixing belt 201 with the thermal conduction aid 216 made of metal. A curve CR indicates temperature change of the fixing belt 201 with the thermal conduction aid 216 made of resin.

As illustrated in FIG. 4, if the thermal conduction aid 216 is made of metal, the thermal conduction aid 216, at the fixing nip N, draws heat from the fixing belt 201 heated by the heat sources 202A and 202B. Hence, compared to the thermal conduction aid 216 made of resin, the thermal conduction aid 216 made of metal causes the fixing belt 201 to be heated to a predetermined temperature slowly, lengthening the warm-up time of the fixing belt 201. For example, the thermal conduction aid 216 made of resin causes the fixing belt 201 to take a time T1 before the fixing belt 201 is heated to the predetermined temperature. The thermal conduction aid 216 made of metal causes the fixing belt 201 to take a time T2, that is longer than the time T1, before the fixing belt 201 is heated to the predetermined temperature. If the thermal conduction aid 216 is made of a material having an increased thermal conductivity such as aluminum and copper, the warm-up time of the fixing belt 201 is lengthened substantially.

If the thermal conduction aid 216 is made of metal, the thermal conduction aid 216 includes a recess that decreases the thermal capacity of the thermal conduction aid 216 advantageously. However, the recess degrades thermal equalization by the thermal conduction aid 216. To address this circumstance, the position and the size of the recess are adjusted properly according to a heat generation distribution of the halogen heaters as the heat sources 202A and 202B and a width of a recording medium S conveyed over the fixing belt 201.

If the recess contacts the fixing belt 201, an edge of the recess may contact the fixing belt 201, hindering stable rotation of the fixing belt 201. To address this circumstance, the fixing device 200 according to the embodiments of the present disclosure incorporates the thermal conduction aid 216 that has the recess disposed in a bent portion that does not contact the fixing belt 201, thus decreasing the thermal capacity of the thermal conduction aid 216 without hindering rotation of the fixing belt 201.

Figure 5A:
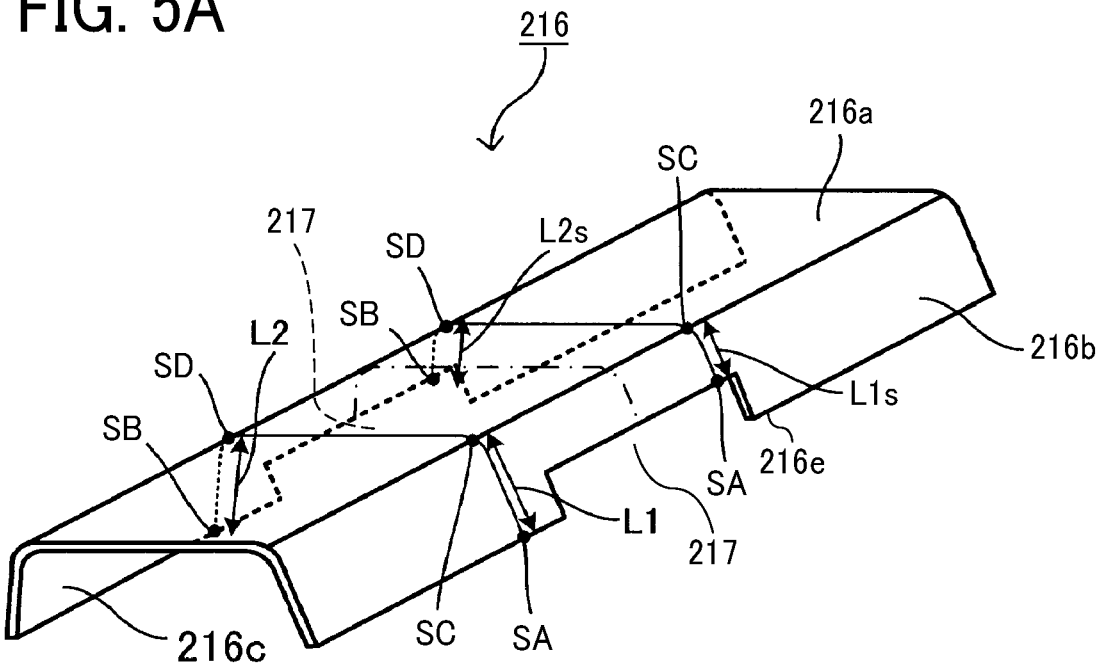
FIG. 5A is an external perspective view of a thermal conduction aid incorporated in the fixing device depicted in FIG. 2, illustrating a recess of the thermal conduction aid.

As illustrated in FIG. 5A, the thermal conduction aid 216 according to the embodiments includes a contact portion 216*a*, bent portions 216*b* and 216*c*, and recesses 217. The contact portion 216*a* contacts the fixing belt 201. The bent portions 216*b* and 216*c* are disposed upstream and downstream from the contact portion 216*a*, respectively, in the rotation direction D201 of the fixing belt 201 and are extended in the longitudinal direction of the thermal conduction aid 216. The recess 217 is disposed in each of the bent portions 216*b* and 216*c*. The recess 217 spans a center of the thermal conduction aid 216 in the longitudinal direction thereof. The recess 217 decreases a length of each of the bent portions 216*b* and 216*c* from the contact portion 216*a* to an edge 216*e* in a short direction of each of the bent portions 216*b* and 216*c*.

The recess 217 may be disposed in at least one of the bent portions 216*b* and 216*c*. However, the recess 217 is preferably disposed in each of the bent portions 216*b* and 216*c*.

The recess 217 disposed in each of the bent portions 216*b* and 216*c* decreases the thermal capacity of the thermal conduction aid 216 even substantially without hindering rotation of the fixing belt 201.

Figure 5B:
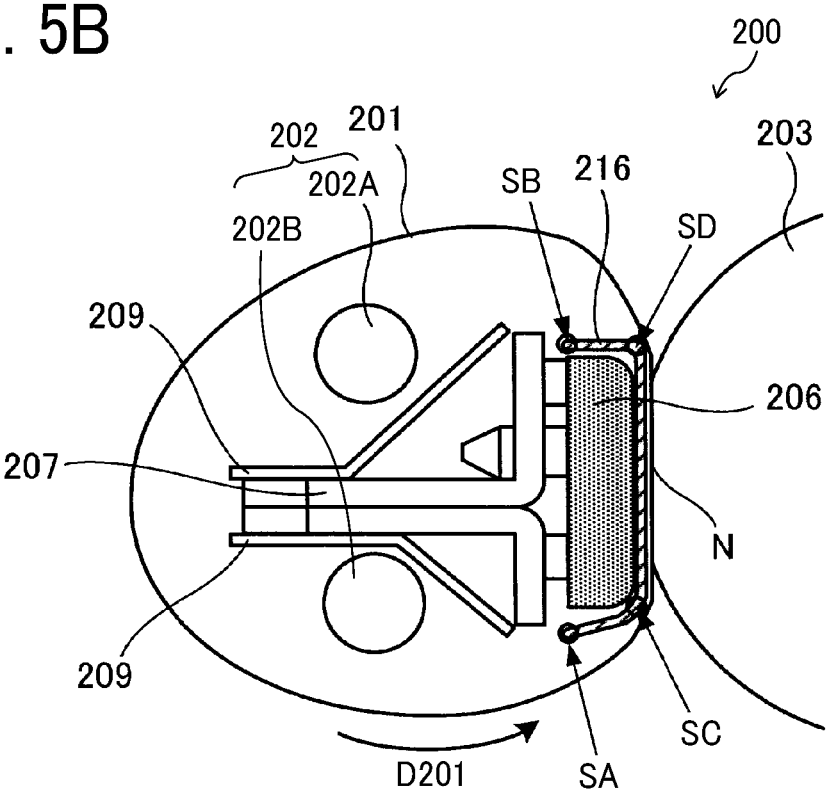
FIG. 5B is a cross-sectional view of the fixing device depicted in FIG. 2, illustrating the thermal conduction aid depicted in FIG. 5A.

Referring to FIGS. 5A and 5B, a description is provided of a configuration of the recess 217 of the thermal conduction aid 216 according to an embodiment.

FIG. 5A is an external perspective view of the thermal conduction aid 216. FIG. 5B is a cross-sectional view of a main section of the fixing device 200 according to the embodiment.

Spots SA, SB, SC, and SD are defined as below on a straight line parallel to a short direction of the thermal conduction aid 216. The spot SA defines a spot on an upstream edge of the bent portion 216*b* in the rotation direction D201 of the fixing belt 201. The spot SB defines a spot on a downstream edge of the bent portion 216*c* in the rotation direction D201 of the fixing belt 201. The spot SC defines a spot on an upstream edge of the contact portion 216*a* in the rotation direction D201 of the fixing belt 201. The spot SD defines a spot on a downstream edge of the contact portion 216*a* in the rotation direction D201 of the fixing belt 201.

A length L1 defines a length between the spots SA and SC. A length L2 defines a length between the spots SB and SD. The thermal conduction aid 216 has a fixed region spanning the center of the thermal conduction aid 216 in the longitudinal direction thereof. In the fixed region, the thermal conduction aid 216 has lengths L1*s* and L2*s* that are shorter than the lengths L1 and L2, respectively. Alternatively, the thermal conduction aid 216 may have the length L1*s* or L2*s*. The fixed region defines the recess 217.

The fixing belt 201 is tubular and is deformed inward by pressure from the pressure roller 203. Hence, the fixing belt 201 draws a trajectory that bulges outward temporarily from the exit of the fixing nip N and separates from the thermal conduction aid 216. Thereafter, as the flanges disposed opposite both lateral ends of the fixing belt 201 in the longitudinal direction thereof pull the fixing belt 201, the fixing belt 201 contacts the thermal conduction aid 216 at the spots SC and SD thereon.

For example, the fixing belt 201 contacts the thermal conduction aid 216 at the spots SC thereon with substantial pressure. Hence, the fixing belt 201 is subject to rubbing against the thermal conduction aid 216 and breakage. To address this circumstance, the thermal conduction aid 216 is preferably shaped such that the fixing belt 201 contacts the thermal conduction aid 216 at the spots SC with decreased pressure.

A length between the spots SC and SD does not shorten in any region on the thermal conduction aid 216. Accordingly, the position and the area where the fixing belt 201 contacts the contact portion 216*a* of the thermal conduction aid 216 do not change, retaining stable rotation of the fixing belt 201.

As illustrated in FIG. 5A, the recess 217 is disposed in each of the bent portions 216*b* and 216*c*. Hence, an edge of the recess 217 does not damage the inner circumferential surface of the fixing belt 201.

As at least one of the lengths L1*s* and L2*s* is close to zero, that is, as the length of the recess 217 in a short direction thereof lengthens, the thermal capacity of the thermal conduction aid 216 decreases, shortening the warm-up time of the fixing belt 201.

A region of the thermal conduction aid 216, where the recess 217 is disposed, is degraded in thermal equalization, compared to other region of the thermal conduction aid 216. To prevent an adverse effect caused by degraded thermal equalization, the position of the recess 217 and the width of the recess 217 in the longitudinal direction of the thermal conduction aid 216 are adjusted properly according to a heat generation distribution of the heat sources 202A and 202B and a width of a recording medium S conveyed over the fixing belt 201.

Figure 6:
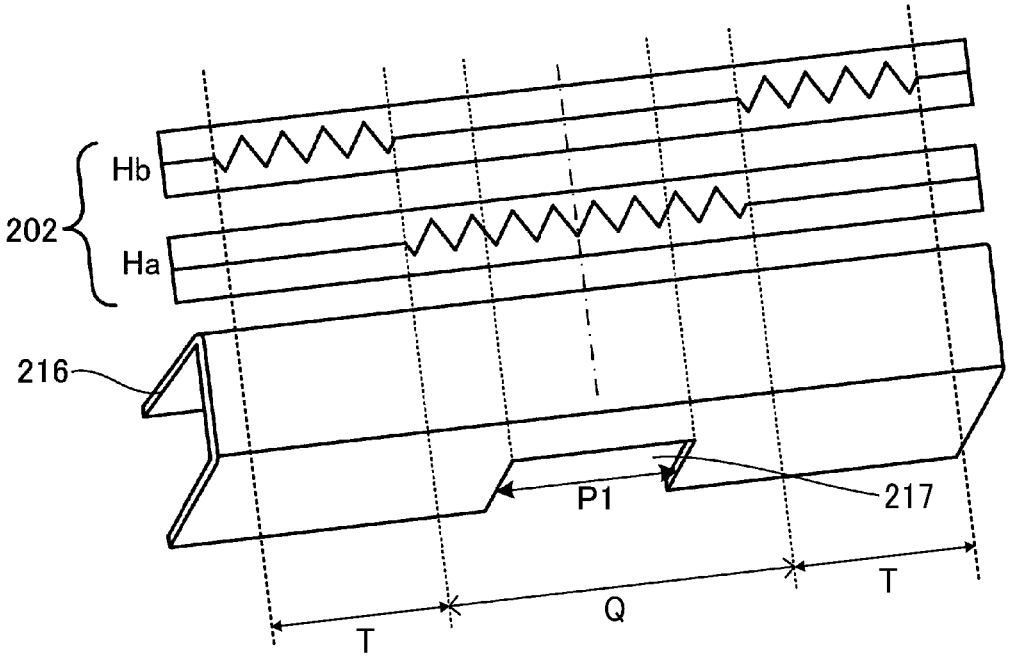
FIG. 6 is a diagram of the thermal conduction aid according to a first embodiment depicted in FIG. 5A, illustrating the recess thereof.
Figure 7:
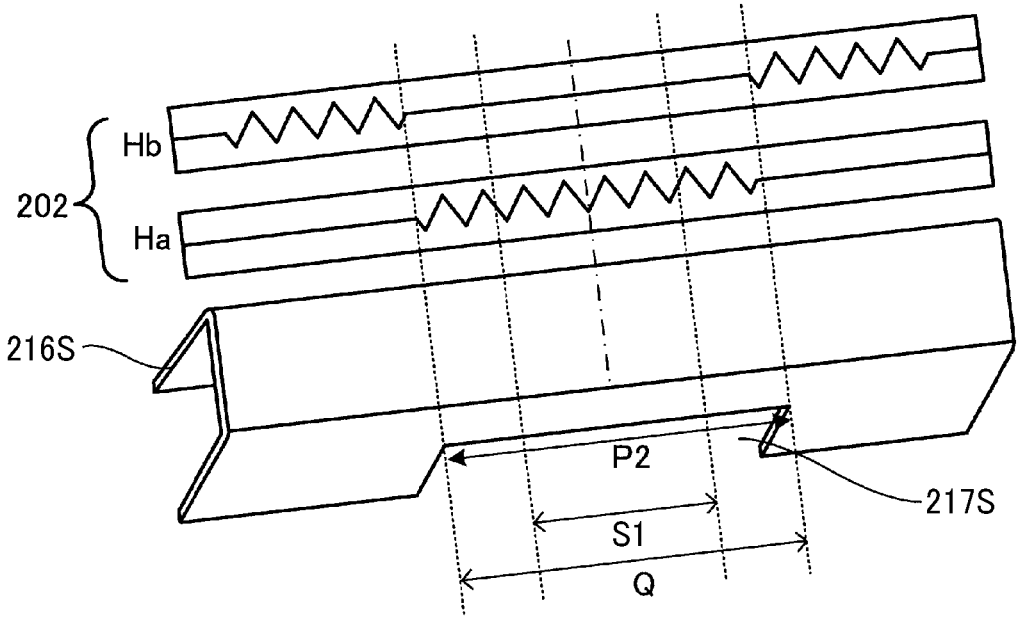
FIG. 7 is a diagram of a thermal conduction aid according to a second embodiment, that is installable in the fixing device depicted in FIG. 2, illustrating a recess thereof.
Figure 8:
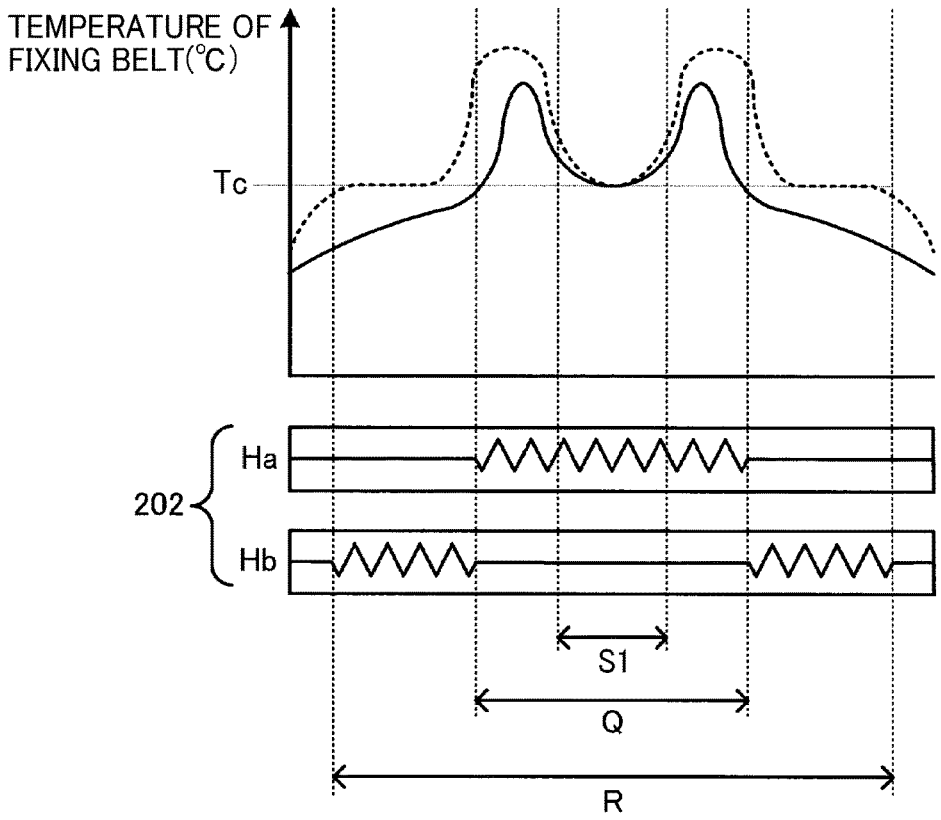
FIG. 8 is a diagram illustrating a temperature distribution of the fixing belt incorporated in the fixing device depicted in FIG. 2, when the temperature of a heat source pair incorporated in the fixing device is controlled while the fixing belt suffers from overheating in a non-conveyance span where a recording medium is not conveyed over the fixing belt.

Referring to FIGS. 6 to 8, a description is provided of the width of the recess 217 disposed in the thermal conduction aid 216 in the longitudinal direction thereof.

A description is provided of a configuration of the thermal conduction aid 216 according to a first embodiment of the present disclosure.

FIG. 6 illustrates the thermal conduction aid 216 according to the first embodiment.

As illustrated in FIG. 6, the heat source pair 202 includes a center heat source Ha and a lateral end heat source Hb that are equivalent to the heat sources 202A and 202B depicted in FIG. 2. An upper part of FIG. 6 is a diagram illustrating a heat generation span of each of the center heat source Ha and the lateral end heat source Hb in a longitudinal direction thereof. The center heat source Ha has a center heat generation span Q spanning a center of the center heat source Ha in the longitudinal direction thereof. The lateral end heat source Hb has lateral end heat generation spans T disposed at both lateral ends of the lateral end heat source Hb, respectively, in the longitudinal direction thereof.

As illustrated in FIG. 6, a width P1 of the recess 217 disposed in the thermal conduction aid 216 in the longitudinal direction thereof is equivalent to a width of a recording medium S having a minimum size of a plurality of sizes available in the fixing device 200. According to the embodiment, the width of the recording medium S having the minimum size is equivalent to a width of a recording medium S having a postcard size.

When a recording medium S having a small size is conveyed over the fixing belt 201, a non-conveyance span on the fixing belt 201, where the recording medium S having the small size is not conveyed, suffers from overheating. The non-conveyance span is disposed outboard from a conveyance span on the fixing belt 201, where the recording medium S having the small size is conveyed, in the longitudinal direction of the fixing belt 201. The conveyance span is within a heated span on the fixing belt 201, that is heated by the heat source pair 202. Accordingly, the fixing belt 201 does not suffer from overheating within a minimum conveyance span where the recording medium S having the minimum size is conveyed. Hence, degradation in thermal equalization by the thermal conduction aid 216, that might be caused by the recess 217 disposed within the minimum conveyance span, is not disadvantageous.

A description is provided of a configuration of a thermal conduction aid 216S according to a second embodiment of the present disclosure.

FIG. 7 illustrates the thermal conduction aid 216S according to the second embodiment.

Similar to the upper part of FIG. 6, an upper part of FIG. 7 is a diagram illustrating the heat generation span of each of the center heat source Ha and the lateral end heat source Hb that construct the heat source pair 202 in the longitudinal direction of the center heat source Ha and the lateral end heat source Hb.

As illustrated in FIG. 7, a width P2 of a recess 217S disposed in the thermal conduction aid 216S in a longitudinal direction thereof is greater than a width Si of the recording medium S having the minimum size of the plurality of sizes available in the fixing device 200. The width P2 of the recess 217S is equivalent to the center heat generation span Q of the center heat source Ha.

According to the second embodiment of the thermal conduction aid 216S, when the recording medium S having the postcard size is conveyed over the fixing belt 201, the fixing belt 201 suffers from temperature increase in the non-conveyance span where the recording medium S having the postcard size is not conveyed over the fixing belt 201. The non-conveyance span is disposed outboard from the minimum conveyance span, where the recording medium S having the postcard size is conveyed, in the longitudinal direction of the fixing belt 201. That is, the non-conveyance span is disposed at least in the center heat generation span Q where the center heat source Ha generates heat. To address this circumstance, the controller decreases a lighting amount of the lateral end heat source Hb or turns off the lateral end heat source Hb, suppressing temperature increase in the non-conveyance span.

Referring to FIG. 8, a description is provided of a temperature distribution of the fixing belt 201 when the non-conveyance span on the fixing belt 201 suffers from temperature increase.

In FIG. 8, a solid line represents a temperature distribution of the fixing belt 201 when the controller decreases the lighting amount of the lateral end heat source Hb or turns off the lateral end heat source Hb. A dotted line represents a temperature distribution of the fixing belt 201 when the controller does not decrease the lighting amount of the lateral end heat source Hb and does not turn off the lateral end heat source Hb. Tc represents a control temperature.

As illustrated in FIG. 8 with the solid line, when the controller controls the lateral end heat source Hb, the fixing belt 201 does not suffer from overheating in an outboard span disposed outboard from the center heat generation span Q of the center heat source Ha in the longitudinal direction thereof and a temperature gradient also increases.

Accordingly, even if the recess 217S is disposed at a part of the thermal conduction aid 216S, that is disposed opposite the center heat generation span Q of the center heat source Ha and is subject to degradation in thermal equalization like the second embodiment illustrated in FIG. 7, heat is diffused sufficiently in the outboard span disposed outboard from the center heat generation span Q and disposed at each lateral end of the fixing belt 201 in the longitudinal direction thereof, thus suppressing temperature increase in the non-conveyance span on the fixing belt 201, where the recording medium S is not conveyed.

A description is provided of a configuration of a thermal conduction aid 216T according to a third embodiment of the present disclosure.

Figure 9:
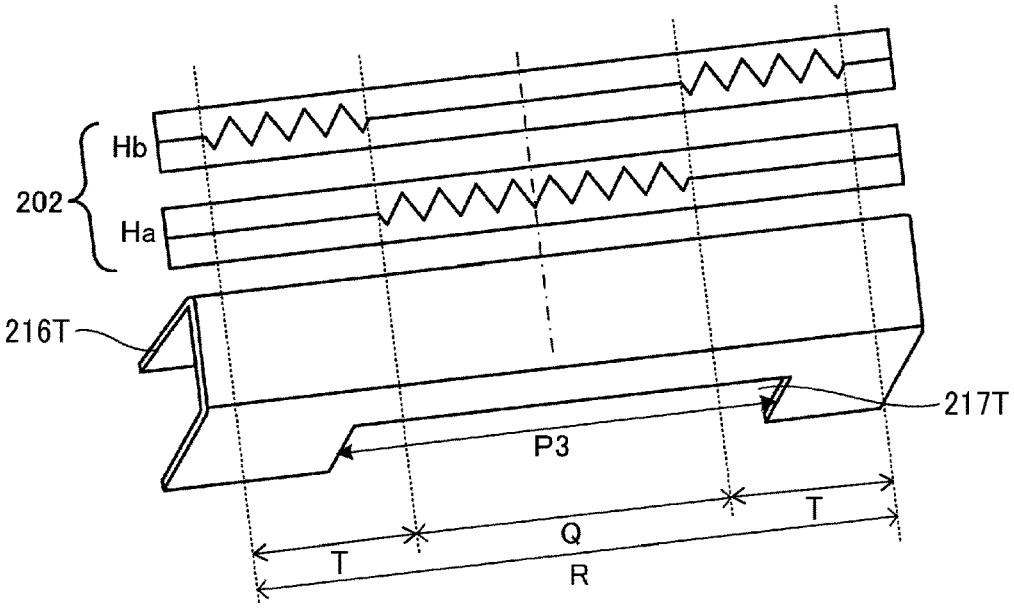
FIG. 9 is a diagram of a thermal conduction aid according to a third embodiment, that is installable in the fixing device depicted in FIG. 2, illustrating a recess thereof.

FIG. 9 illustrates the thermal conduction aid 216T according to the third embodiment.

Similar to the upper part of FIGS. 6 and 7, an upper part of FIG. 9 is a diagram illustrating the heat generation span of each of the center heat source Ha and the lateral end heat source Hb that construct the heat source pair 202 in the longitudinal direction of the center heat source Ha and the lateral end heat source Hb.

As illustrated in FIG. 9, a width P3 of a recess 217T disposed in the thermal conduction aid 216T in a longitudinal direction thereof is greater than the center heat generation span Q of the center heat source Ha. The width P3 of the recess 217T is smaller than a combined span R of the center heat generation span Q and both lateral end heat generation spans T of the lateral end heat source Hb in the longitudinal direction thereof.

According to the third embodiment depicted in FIG. 9, the recess 217T having the increased, width P3 may degrade thermal equalization by the thermal conduction aid 216T slightly. Conversely, the recess 217T shortens a warm-up time of the fixing device 200.

Thermal diffusion by the thermal conduction aid 216T is confirmed as below. The thermal conduction aid 216T conducts heat also inward from both lateral edges of a recording medium S in the longitudinal direction of the thermal conduction aid 216T, that is conveyed over the fixing belt 201, in a span of about 20 mm.

Accordingly, the width P3 of the recess 217T is defined based on a width calculated by subtracting about 20 mm from a width of a recording medium S at each lateral edge of the recording medium S in the longitudinal direction of the thermal conduction aid 216T. The recording medium S has a size that attains desired productivity. For example, the recording medium S is a sheet having a maximum size of a plurality of sizes available in the fixing device 200 (e.g., a long recording medium having a double letter size or the like).

Alternatively, the width P3 of the recess 217T may be properly selected or designed by balancing with shortening of the warm-up time of the fixing device 200.

A description is provided of a configuration of a positioner 218 incorporated in the fixing device 200.

FIGS. 10A, 10B, 10C, and 10D are diagrams illustrating a method of positioning the thermal conduction aid 216 with respect to the nip former 206.

Figure 10A:
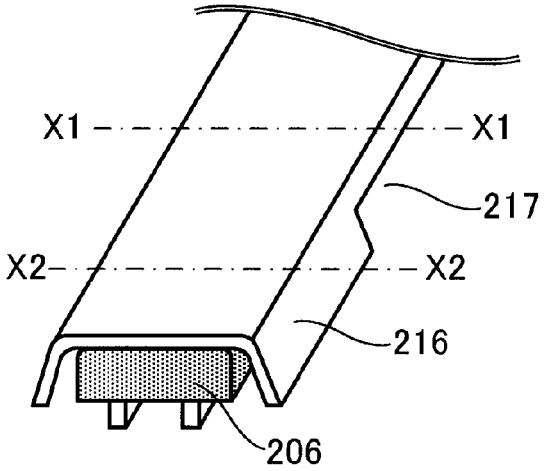
FIG. 10A is a partial perspective view of the thermal conduction aid and a nip former incorporated in the fixing device depicted in FIG. 2.
Figure 10B:
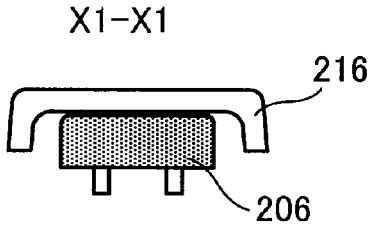
FIG. 10B is a cross-sectional view of the thermal conduction aid and the nip former depicted in FIG. 10A, taken on line X1-X1 in FIG. 10A.
Figure 10C:
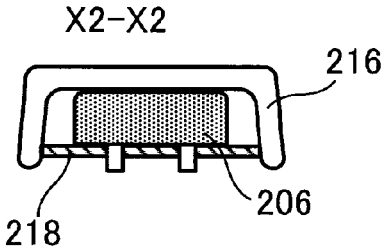
FIG. 10C is a cross-sectional view of the thermal conduction aid and the nip former depicted in FIG. 10A, taken on line X2-X2 in FIG. 10A.
Figure 10D:
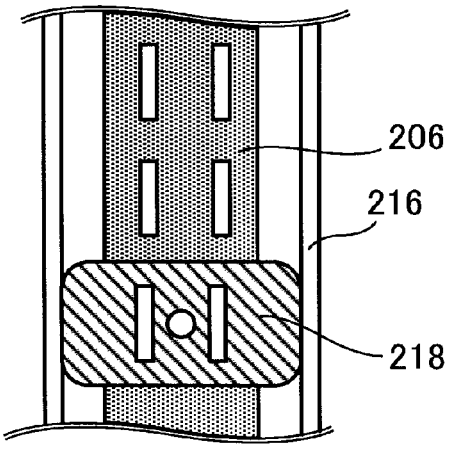
FIG. 10D is a plan view of the thermal conduction aid and the nip former depicted in FIG. 10C, illustrating a positioner that positions the thermal conduction aid with respect to the nip former.

FIG. 10A is an external perspective view of the thermal conduction aid 216 and the nip former 206. FIG. 10B is a cross-sectional view of the thermal conduction aid 216 and the nip former 206 taken on line X1-X1 in FIG. 10A. FIG. 10C is a cross-sectional view of the thermal conduction aid 216 and the nip former 206 taken on line X2-X2 in FIG. 10A. FIG. 10D is a plan view of the thermal conduction aid 216 and the nip former 206 seen from a viewpoint that faces the nip former 206.

At a cross section taken on line X1-X1 in FIG. 10A in the short direction of the thermal conduction aid 216, the recess 217 is disposed in the thermal conduction aid 216. At a cross section taken on line X2-X2 in FIG. 10A in the short direction of the thermal conduction aid 216, the recess 217 is not disposed in the thermal conduction aid 216.

Preferably, the contact portion 216*a* of the thermal conduction aid 216, that defines the fixing nip N, contacts the nip former 206. Preferably, the bent portions 216*b* and 216*c*, that define side faces of the thermal conduction aid 216, respectively, do not contact the nip former 206. Thus, the thermal conduction aid 216 contacts the nip former 206 in a decreased area, preventing heat from diffusing from the thermal conduction aid 216 to the nip former 206 and thereby preventing the warm-up time of the fixing belt 201 from being lengthened.

The positioner 218 preferably secures the nip former 206 to the thermal conduction aid 216 in the short direction of the thermal conduction aid 216.

As illustrated in FIGS. 10C and 10D, the fixing device 200 according to this embodiment includes the positioner 218 that positions and secures the thermal conduction aid 216 with respect to the nip former 206. The positioner 218 engages a part of each of the bent portions 216*b* and 216*c* of the thermal conduction aid 216, where the recess 217 is not disposed.

The positioner 218 preferably contacts the thermal conduction aid 216 in a decreased area. For example, as illustrated in FIGS. 10C and 10D, the positioner 218 engages a part of each of the bent portions 216*b* and 216*c* of the thermal conduction aid 216, other than another part of each of the bent portions 216*b* and 216*c* of the thermal conduction aid 216, where the recess 217 is disposed.

The fixing device 200 preferably incorporates at least a pair of positioners 218 such that the positioners 218 are symmetrically disposed with respect to the center of the thermal conduction aid 216 in the longitudinal direction thereof.

The thermal conduction aid 216 is requested to achieve thermal equalization in a region thereof where the recess 217 is not disposed. Conversely, in a region of the thermal conduction aid 216, where the positioner 218 is disposed, heat is diffused from the thermal conduction aid 216 to the nip former 206 through the positioner 218. However, the positioner 218 advantageously dissipates heat from the non-conveyance span on the fixing belt 201, where the recording medium S is not conveyed. Hence, the positioner 218 is preferable as long as the positioner 218 does not adversely affect the warm-up time of the fixing belt 201, because the positioner 218 allows the thermal conduction aid 216 to retain thermal equalization.

The fixing device 200 according to the embodiments includes the thermal conduction aid 216, 216S, or 216T according to the first embodiment, the second embodiment, or the third embodiment as described above. Accordingly, while the fixing device 200 shortens the warm-up time of the fixing belt 201, the fixing device 200 prevents temperature increase in the non-conveyance span on the fixing belt 201, where small recording media S are not conveyed, when the small recording media S are conveyed through the fixing device 200 continuously. Additionally, the fixing device 200 attains stable rotation of the fixing belt 201.

A description is provided of advantages of a fixing device (e.g., the fixing device 200).

As illustrated in FIGS. 2, 5A, 5B, 7, and 9, the fixing device includes an endless belt (e.g., the fixing belt 201), a heat source (e.g., the heat sources 202A and 202B), a nip former (e.g., the nip former 206), a thermal conduction aid (e.g., the thermal conduction aids 216, 216S, and 216T), and a pressure rotator (e.g., the pressure roller 203).

The endless belt is rotatable in a rotation direction (e.g., the rotation direction D201) and serves as a fixing rotator or a fixing member. The heat source heats the endless belt. The nip former is stationarily disposed within a loop formed by the endless belt. The nip former does not rotate. The thermal conduction aid facilitates conduction of heat in the endless belt. The pressure rotator is disposed opposite an outer circumferential surface of the endless belt. The pressure rotator is disposed opposite the nip former via the endless belt to form a nip (e.g., the fixing nip N) between the endless belt and the pressure rotator. As a recording medium (e.g., a recording medium S) bearing an unfixed toner image is conveyed through the nip, the endless belt and the pressure rotator fix the unfixed toner image on the recording medium.

The thermal conduction aid includes a contact portion (e.g., the contact portion 216*a*), an upstream bent portion (e.g., the bent portion 216*b*), a downstream bent portion (e.g., the bent portion 216*c*), and a recess (e.g., the recesses 217, 217S, and 217T).

The contact portion contacts the endless belt. The upstream bent portion and the downstream bent portion are disposed upstream and downstream from the contact portion, respectively, in the rotation direction of the endless belt and are extended in a longitudinal direction of the thermal conduction aid. The recess is disposed in at least one of the upstream bent portion and the downstream bent portion. The recess spans a center of the thermal conduction aid in the longitudinal direction thereof. The recess decreases a length of at least one of the upstream bent portion and the downstream bent portion from the contact portion to an edge (e.g., the edge 216*e*) of the at least one of the upstream bent portion and the downstream bent portion in a short direction thereof. In other words, the recess is disposed in at least one of the upstream bent portion and the downstream bent portion and recessed from the edge of the at least one of the upstream bent portion and the downstream bent portion in the short direction thereof.

Accordingly, while the fixing device shortens a warm-up time of the endless belt, the fixing device prevents temperature increase in a non-conveyance span on the endless belt, where recording media having a decreased size are not conveyed, when the recording media having the decreased size are conveyed through the fixing device continuously. Additionally, the fixing device attains stable rotation of the endless belt.

According to the embodiments described above, the fixing belt 201 serves as a fixing rotator or an endless belt. Alternatively, a fixing film, a fixing sleeve, or the like may be used as a fixing rotator or an endless belt. Further, the pressure roller 203 serves as a pressure rotator. Alternatively, a pressure belt or the like may be used as a pressure rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device, comprising:

an endless belt configured to rotate in a rotation direction;

a heat source configured to heat the endless belt;

a nip former stationarily disposed within a loop formed by the endless belt;

a pressure rotator disposed opposite the nip former via the endless belt to form a nip between the endless belt and the pressure rotator, the nip through which a recording medium bearing an image is conveyed; and a thermal conduction aid configured to facilitate conduction of heat in the endless belt, the thermal conduction aid including:

a contact portion configured to contact the endless belt;

an upstream bent portion disposed upstream from the contact portion in the rotation direction of the endless belt and extended in a longitudinal direction of the thermal conduction aid;

a downstream bent portion disposed downstream from the contact portion in the rotation direction of the endless belt and extended in the longitudinal direction of the thermal conduction aid; and a recess disposed in at least one of the upstream bent portion and the downstream bent portion, the recess spanning a center of the thermal conduction aid in the longitudinal direction of the thermal conduction aid and being recessed from an edge of the at least one of the upstream bent portion and the downstream bent portion in a short direction of the at least one of the upstream bent portion and the downstream bent portion, wherein a width of the recess in the longitudinal direction of the thermal conduction aid is equivalent to a width of the recording medium having a minimum size of a plurality of sizes that is available in the fixing device.

2. The fixing device according to claim 1, further comprising another heat source configured to heat the endless belt, wherein the heat source has a center heat generation span spanning a center of the heat source in a longitudinal direction of the heat source, and wherein said another heat source has a lateral end heat generation span disposed at a lateral end of said another heat source in a longitudinal direction of said another heat source.

3. The fixing device according to claim 2, wherein a width of the recess in the longitudinal direction of the thermal conduction aid is greater than a width of the recording medium having the minimum size of the plurality of sizes that is available in the fixing device, and wherein the width of the recess in the longitudinal direction of the thermal conduction aid is equivalent to the center heat generation span.

4. The fixing device according to claim 2, wherein a width of the recess in the longitudinal direction of the thermal conduction aid is greater than the center heat generation span, and wherein the width of the recess in the longitudinal direction of the thermal conduction aid is smaller than a combined span of the center heat generation span and the lateral end heat generation span.

5. The fixing device according to claim 1, wherein the recess decreases a length of the at least one of the upstream bent portion and the downstream bent portion from the contact portion to the edge of the at least one of the upstream bent portion and the downstream bent portion in the short direction of the at least one of the upstream bent portion and the downstream bent portion.

6. The fixing device according to claim 1, wherein the upstream bent portion and the downstream bent portion do not contact the endless belt.

7. The fixing device according to claim 1, wherein the contact portion contacts the nip former, and wherein the upstream bent portion and the downstream bent portion do not contact the nip former.

8. A fixing device, comprising:

an endless belt configured to rotate in a rotation direction;

a heat source configured to heat the endless belt;

a nip former stationarily disposed within a loop formed by the endless belt;

a pressure rotator disposed opposite the nip former via the endless belt to form a nip between the endless belt and the pressure rotator, the nip through which a recording medium bearing an image is conveyed; and a thermal conduction aid configured to facilitate conduction of heat in the endless belt, the thermal conduction aid including:

a contact portion configured to contact the endless belt;

an upstream bent portion disposed upstream from the contact portion in the rotation direction of the endless belt and extended in a longitudinal direction of the thermal conduction aid;

a downstream bent portion disposed downstream from the contact portion in the rotation direction of the endless belt and extended in the longitudinal direction of the thermal conduction aid; and a recess disposed in at least one of the upstream bent portion and the downstream bent portion, the recess spanning a center of the thermal conduction aid in the longitudinal direction of the thermal conduction aid and being recessed from an edge of the at least one of the upstream bent portion and the downstream bent portion in a short direction of the at least one of the upstream bent portion and the downstream bent portion, wherein the fixing device further includes a positioner configured to secure and position the thermal conduction aid with respect to the nip former, the positioner configured to engage each of the upstream bent portion and the downstream bent portion at a position other than the recess.

9. An image forming apparatus, comprising:

an image bearer configured to bear an image; and a fixing device configured to fix the image on a recording medium, the fixing device including:

an endless belt configured to rotate in a rotation direction;

a heat source configured to heat the endless belt;

a nip former stationarily disposed within a loop formed by the endless belt;

a pressure rotator disposed opposite the nip former via the endless belt to form a nip between the endless belt and the pressure rotator, the nip through which the recording medium bearing the image is conveyed; and a thermal conduction aid configured to facilitate conduction of heat in the endless belt, the thermal conduction aid including:

a contact portion configured to contact the endless belt;

an upstream bent portion disposed upstream from the contact portion in the rotation direction of the endless belt and extended in a longitudinal direction of the thermal conduction aid;

a downstream bent portion disposed downstream from the contact portion in the rotation direction of the endless belt and extended in the longitudinal direction of the thermal conduction aid; and a recess disposed in at least one of the upstream bent portion and the downstream bent portion, the recess spanning a center of the thermal conduction aid in the longitudinal direction of the thermal conduction aid and being recessed from an edge of the at least one of the upstream bent portion and the downstream bent portion in a short direction of the at least one of the upstream bent portion and the downstream bent portion, wherein a width of the recess in the longitudinal direction of the thermal conduction aid is equivalent to a width of the recording medium having a minimum size of a plurality of sizes that is available in the fixing device.

* * * * *